US010907659B2

(12) United States Patent
Kondo et al.

(10) Patent No.: US 10,907,659 B2
(45) Date of Patent: Feb. 2, 2021

(54) HYDRAULIC SYSTEM

(71) Applicant: KAWASAKI JUKOGYO KABUSHIKI KAISHA, Kobe (JP)

(72) Inventors: Akihiro Kondo, Kobe (JP); Hiroaki Mitsui, Kobe (JP); Toshihisa Toyota, Kobe (JP); Haruo Yamada, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/652,134

(22) PCT Filed: Sep. 21, 2018

(86) PCT No.: PCT/JP2018/035102

§ 371 (c)(1),
(2) Date: Mar. 30, 2020

(87) PCT Pub. No.: WO2019/065510

PCT Pub. Date: Apr. 4, 2019

(65) Prior Publication Data

US 2020/0248721 A1 Aug. 6, 2020

(30) Foreign Application Priority Data

Sep. 29, 2017 (JP) ..... 2017-190723

(51) Int. Cl.
*F15B 11/02* (2006.01)
*F15B 11/08* (2006.01)

(52) U.S. Cl.
CPC ..... *F15B 11/02* (2013.01); *F15B 11/08* (2013.01)

(58) Field of Classification Search
CPC ..... F15B 2211/6652; F15B 2211/785; F15B 11/02; F15B 11/08; F15B 2211/20553
See application file for complete search history.

(56) References Cited

U.S. PATENT DOCUMENTS 6,886,332 B2 * 5/2005 Kubinski ..... F15B 7/006 60/475
8,839,617 B2 * 9/2014 Nelson ..... F15B 21/14 60/418

(Continued)

FOREIGN PATENT DOCUMENTS

JP 2004-257448 A 9/2004

*Primary Examiner* — Abiy Teka
(74) *Attorney, Agent, or Firm* — Oliff PLC

(57) ABSTRACT

A hydraulic system includes: a single-rod hydraulic cylinder; a variable displacement pump driven by a rotating machine; a rod-side supply line and a head-side supply line that connect the pump to the hydraulic cylinder; a first tank line that is branched off from the rod-side supply line and connects to a tank; a second tank line that is branched off from the head-side supply line and connects to the tank; and a flow rate adjuster. The flow rate adjuster is configured to: switch a delivery capacity of the pump to a first setting value when a pressure of the head-side supply line is higher than a pressure of the rod-side supply line; and switch the delivery capacity of the pump to a second setting value less than the first setting value when the pressure of the rod-side supply line is higher than the pressure of the head-side supply line.

5 Claims, 6 Drawing Sheets

(56) References Cited

U.S. PATENT DOCUMENTS

| | | | | |
|---|---|---|---|---|
| 8,997,626 | B2 * | 4/2015 | Anderson | F16K 17/08 91/437 |
| 9,080,310 | B2 * | 7/2015 | Knussman | E02F 9/2285 |
| 9,829,013 | B2 * | 11/2017 | Cho | E02F 9/2289 |

* cited by examiner

HYDRAULIC SYSTEM

TECHNICAL FIELD

The present invention relates to a hydraulic system in which a single-rod hydraulic cylinder and a pump are connected in a manner to form a closed circuit.

BACKGROUND ART

Conventionally, there is a known hydraulic system in which a single-rod hydraulic cylinder and a pump are connected in a manner to form a closed circuit. For example, Patent Literature 1 discloses a hydraulic system 100 as shown in FIGS. 5A and 5B.

In the hydraulic system 100, a single-rod hydraulic cylinder 120 and a pump 110 are connected by a rod-side supply line 131 and a head-side supply line 132 in a manner to form a closed circuit. A first tank line 141 is branched off from the rod-side supply line 131, and a second tank line 151 is branched off from the head-side supply line 132. The first tank line 141 and the second tank line 151 are provided with a pilot check valve 142 and a pilot check valve 152, respectively.

The pilot check valve 142 provided on the first tank line 141 stops exerting its reverse flow preventing function when the pressure of the head-side supply line 132 is high, and the pilot check valve 152 provided on the second tank line 151 stops exerting its reverse flow preventing function when the pressure of the rod-side supply line 131 is high.

CITATION LIST

Patent Literature

PTL 1: Japanese Laid-Open Patent Application Publication No. 2004-257448

SUMMARY OF INVENTION

Technical Problem

In the hydraulic system 100 disclosed in Patent Literature 1, in a case where the direction of a load applied to the hydraulic cylinder 120 when the cylinder 120 extends is the retracting direction of the cylinder 120 as shown in FIG. 5A, the pressure of the head-side supply line 132 becomes high against the load, and the speed of the hydraulic cylinder 120 is controlled by the delivery flow rate of the pump 110. At the time, a hydraulic liquid at a flow rate corresponding to the pressure receiving area difference between the head-side chamber and the rod-side chamber of the hydraulic cylinder 120 is sucked from a tank 160 through the pilot check valve 142 of the first tank line 141.

However, if the direction of the load applied to the cylinder 120 is reversed into the extending direction of the cylinder 120 as shown in FIG. 5B, the pressure of the rod-side supply line 131 becomes high against the load, and the speed of the hydraulic cylinder 120 is controlled by the suction flow rate of the pump 110, accordingly. At the time, the hydraulic liquid at a flow rate corresponding to the pressure receiving area difference between the head-side chamber and the rod-side chamber of the hydraulic cylinder 120 is sucked from the tank 160 through the pilot check valve 152 of the second tank line 151. Thus, if the load direction is reversed from the retracting direction into the extending direction when the hydraulic cylinder 120 extends, the pressure of the head-side chamber and the pressure of the rod-side chamber change rapidly. As a result, not only a mechanical shock, but also a change in the speed of the hydraulic cylinder 120 occurs. To be more specific, immediately after the load direction is reversed from the retracting direction into the extending direction, the pump suction flow rate (theoretical flow rate) becomes insufficient relative to the flow rate discharged from the rod side. For this reason, no force against the load is generated, and the speed of the hydraulic cylinder 120 increases due to the load. As a result of the increase in the cylinder speed, the flow rate into the pump 110 becomes equal to the theoretical delivery flow rate (theoretical suction flow rate) of the pump 110. Consequently, pressure is generated at the rod side, and thereby the speed of the hydraulic cylinder 120 becomes constant. At the moment when the force against the load (external force) applied to the cylinder disappears, and also, at the moment when the flow rate into the pump 110 becomes equal to the pump suction flow rate, a shock occurs. Such a change in the speed of the hydraulic cylinder due to the reversal of the load direction occurs also when the load direction is reversed from the extending direction into the retracting direction.

In a case where the load direction when the hydraulic cylinder 120 retracts is the extending direction as shown in FIG. 6A, the pressure of the rod-side supply line 131 becomes high against the load, and the speed of the hydraulic cylinder 120 is controlled by the delivery flow rate of the pump 110. At the time, the pilot check valve 152 of the second tank line 151 is opened, and the hydraulic liquid at a flow rate corresponding to the pressure receiving area difference between the head-side chamber and the rod-side chamber of the hydraulic cylinder 120 flows into the tank 160 through the second tank line 151.

However, if the load direction is reversed into the retracting direction as shown in FIG. 6B, the pressure of the head-side supply line 132 becomes high against the load, and the speed of the hydraulic cylinder 120 is controlled by the suction flow rate of the pump 110. At the time, the pilot check valve 152 of the second tank line 151 is closed, and the flow rate from the head side entirely flows into the suction side of the pump 110. Also, the pilot check valve 142 of the first tank line 141 is opened due to the pressure of the head-side supply line 132, and the hydraulic liquid at a flow rate corresponding to the pressure receiving area difference between the head-side chamber and the rod-side chamber of the hydraulic cylinder 120 flows into the tank 160 through the first tank line 141. That is, if the load direction is reversed from the extending direction into the retracting direction when the hydraulic cylinder 120 retracts, not only a mechanical shock, but also a change in the speed of the hydraulic cylinder 120 occurs. To be more specific, the flow rate into the pump 110 increases rapidly, and a rapid increase in the suction side pressure occurs, the rapid increase corresponding to an excess of the flow rate over the theoretical delivery (suction) flow rate of the pump 110. At the same time, the speed of the hydraulic cylinder 120 decreases rapidly. Thus, if the load direction is reversed from the extending direction into the retracting direction when the hydraulic cylinder 120 retracts, a rapid change in the speed of the hydraulic cylinder as well as a shock occurs. Such a change in the speed of the hydraulic cylinder due to the reversal of the load direction occurs also when the load direction is reversed from the retracting direction into the extending direction.

In order to suppress the above-described change in the speed of the hydraulic cylinder 120, which occurs in both cases where the load direction is reversed when the hydraulic cylinder extends and where the load direction is reversed when the hydraulic cylinder retracts, it is conceivable to instantaneously change the rotation speed of a rotating machine that drives the pump 110. However, for example, in a case where the rotating machine is an engine, such control is difficult. Alternatively, in a case where the rotating machine is a servomotor, a device that detects the cylinder stroke speed and sensors that detect the pressures of both ports of the pump are required, and thus the configuration of the hydraulic system becomes complex.

In view of the above, an object of the present invention is to provide a hydraulic system that is capable of suppressing a change in the speed of the hydraulic cylinder in both cases where the load direction is reversed when the hydraulic cylinder extends and where the load direction is reversed when the hydraulic cylinder retracts, without instantaneously changing the rotation speed of the rotating machine.

Solution to Problem

In order to solve the above-described problems, a hydraulic system according to the present invention includes: a single-rod hydraulic cylinder including a rod-side chamber and a head-side chamber; a variable displacement pump driven by a rotating machine, the pump including a first port and a second port; a flow rate adjuster that switches a delivery capacity per rotation of the pump between a first setting value and a second setting value less than the first setting value; a rod-side supply line that connects the first port to the rod-side chamber; a head-side supply line that connects the second port to the head-side chamber in a manner to form a closed circuit together with the pump, the rod-side supply line, and the hydraulic cylinder; a first tank line that is branched off from the rod-side supply line and connects to a tank; a first pilot check valve provided on the first tank line, the first pilot check valve allowing a flow from the tank toward the rod-side supply line and preventing a reverse flow, but stopping exerting a function of preventing the reverse flow when a pressure of the head-side supply line is higher than a first setting pressure; a second tank line that is branched off from the head-side supply line and connects to the tank; and a second pilot check valve provided on the second tank line, the second pilot check valve allowing a flow from the tank toward the head-side supply line and preventing a reverse flow, but stopping exerting a function of preventing the reverse flow when a pressure of the rod-side supply line is higher than a second setting pressure. The pressure of the rod-side supply line and the pressure of the head-side supply line are led to the flow rate adjuster. The flow rate adjuster is configured to: switch the delivery capacity of the pump to the first setting value when the pressure of the head-side supply line is higher than the pressure of the rod-side supply line; and switch the delivery capacity of the pump to the second setting value when the pressure of the rod-side supply line is higher than the pressure of the head-side supply line.

According to the above configuration, if the load direction is reversed from the retracting direction into the extending direction of the hydraulic cylinder when the hydraulic cylinder extends, the pressure of the rod-side supply line becomes high against the load, and the state of the cylinder speed control changes from the state of being controlled by the supply flow rate to the head side to the state of being controlled by the discharge flow rate from the rod side. At the time, the pump delivery (suction) capacity decreases, and the pump delivery (suction) flow rate decreases. As a result, the pump suction flow rate can be made equal to the discharge flow rate from the rod side. In addition, at the time, the passage through which the hydraulic liquid is sucked from the tank is switched from the first tank line to the second tank line. In this manner, a change (an increase) in the speed of the hydraulic cylinder can be suppressed without instantaneously changing the rotation speed of the rotating machine.

On the other hand, if the load direction is reversed from the extending direction into the retracting direction when the hydraulic cylinder extends, the pressure of the head-side supply line becomes high against the load, and the cylinder speed control changes from the control by the discharge flow rate from the rod side to the control by the supply flow rate to the head side. At the time, the pump delivery (suction) capacity increases, and the pump delivery (suction) flow rate increases, accordingly. As a result, the pump delivery flow rate can be made equal to the supply flow rate to the head side. In addition, at the time, the passage through which the hydraulic liquid is sucked from the tank is switched from the second tank line to the first tank line. In this manner, a change (a decrease) in the speed of the hydraulic cylinder can be suppressed without instantaneously changing the rotation speed of the rotating machine.

If the load direction is reversed from the extending direction into the retracting direction when the hydraulic cylinder retracts, since the pressure of the head-side supply line becomes high against the load, the delivery (suction) capacity of the pump increases, and the delivery (suction) flow rate increases. At the time, the passage through which the hydraulic liquid flows into the tank is switched from the second tank line to the first tank line. In this manner, a change (a decrease) in the speed of the hydraulic cylinder can be suppressed without instantaneously changing the rotation speed of the rotating machine.

On the other hand, if the load direction is reversed from the retracting direction into the extending direction when the hydraulic cylinder retracts, since the pressure of the rod-side supply line becomes high against the load, the pump delivery (suction) capacity decreases, and the pump delivery (suction) flow rate decreases. At the time, the passage through which the hydraulic liquid flows into the tank is switched from the first tank line to the second tank line. In this manner, a change (an increase) in the speed of the hydraulic cylinder can be suppressed without instantaneously changing the rotation speed of the rotating machine.

Moreover, the pressure of the rod-side supply line and the pressure of the head-side supply line are led to the flow rate adjuster, and the flow rate adjuster is controlled by these pressures. Therefore, it is not necessary to electrically control the flow rate adjuster.

A ratio between the first setting value and the second setting value may be equal to a ratio between a pressure receiving area of the head-side chamber and a pressure receiving area of the rod-side chamber of the hydraulic cylinder. This configuration makes it possible to markedly suppress a change in the speed of the hydraulic cylinder.

For example, the rotating machine may be a servomotor, and a delivery side and a suction side of the first and second ports of the pump may be switched with each other in accordance with a rotation direction of the rotating machine. Alternatively, a delivery side and a suction side of the first and second ports of the pump may be switched with each other by tilting a swash plate or a tilted axis of the pump bi-directionally over a reference line.

Advantageous Effects of Invention

The present invention makes it possible to suppress a change in the speed of the hydraulic cylinder in both cases where the load direction is reversed when the hydraulic cylinder extends and where the load direction is reversed when the hydraulic cylinder retracts, without instantaneously changing the rotation speed of the rotating machine.

BRIEF DESCRIPTION OF DRAWINGS

FIG. 2A shows the flow in a case where the load direction is the retracting direction of the hydraulic cylinder; and FIG. 2B shows the flow in a case where the load direction is the extending direction of the hydraulic cylinder.

FIG. 3A shows the flow in a case where the load direction is the extending direction; and FIG. 3B shows the flow in a case where the load direction is the retracting direction.

DESCRIPTION OF EMBODIMENTS

Figure 1:
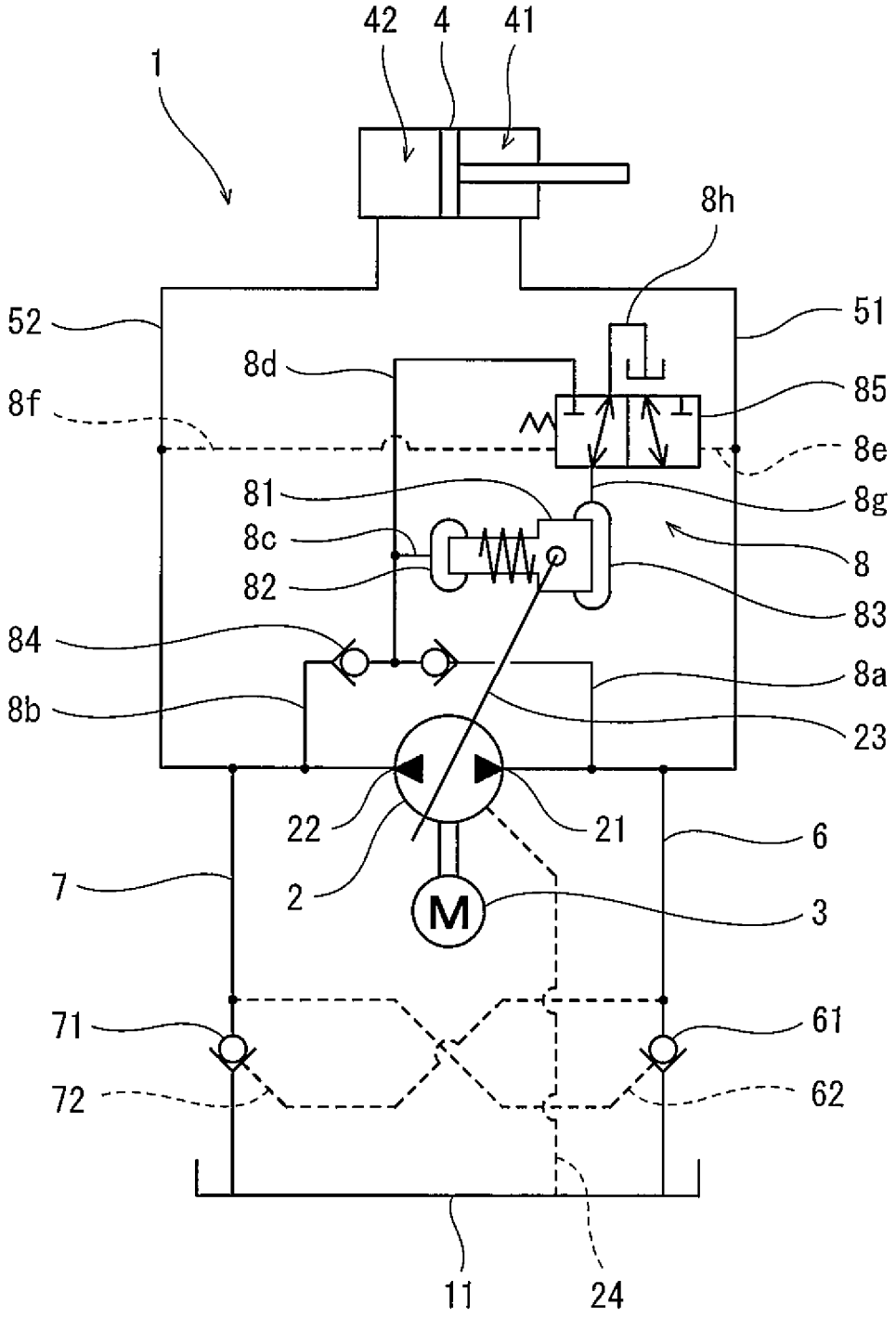
FIG. 1 shows a schematic configuration of a hydraulic system according to one embodiment of the present invention.

FIG. 1 shows a hydraulic system 1 according to one embodiment of the present invention. The hydraulic system 1 includes: a single-rod hydraulic cylinder 4; a pump 2 connected to the hydraulic cylinder 4 in a manner to form a closed circuit; and a rotating machine 3 driving the pump 2. A hydraulic liquid flowing through the closed circuit is typically oil, but may be a liquid different from oil.

The hydraulic cylinder 4 includes a rod-side chamber 41 and a head-side chamber 42, which are partitioned from each other by a piston. A rod extends from the piston and penetrates the rod-side chamber 41.

The pump 2 includes a first port 21 and a second port 22. The first port 21 is connected to the rod-side chamber 41 of the hydraulic cylinder 4 by a rod-side supply line 51, and the second port 22 is connected to the head-side chamber 42 of the hydraulic cylinder 4 by a head-side supply line 52. With these rod-side supply line 51 and head-side supply line 52, the aforementioned closed circuit is formed between the pump 2 and the hydraulic cylinder 4.

In the present embodiment, the pump 2 is a variable displacement swash plate pump including a swash plate 23, and the rotating machine 3 is a servomotor. The delivery side and the suction side of the first and second ports 21 and 22 of the pump 2 are switched with each other in accordance with the rotation direction of the rotating machine 3. The speed and position of the hydraulic cylinder 4 are controlled by controlling the rotation speed and rotation angle of the servomotor.

It should be noted that the pump 2 may be a bent axis pump. Alternatively, the pump 2 may be an over-center pump configured such that, even though the rotation direction remains the same direction, the delivery side and the suction side of the first and second ports 21 and 22 are switchable with each other by tilting the swash plate or the tilted axis bi-directionally over a reference line (in a case where the pump 2 is a swash plate pump, the reference line is a line orthogonal to the center line of the pump 2, whereas in a case where the pump 2 is a bent axis pump, the reference line is the center line of the pump 2). In this case, the rotating machine 3 may be an engine.

In the present embodiment, a drain line 24 extends from the pump 2 to a tank 11. When the pump 2 is driven, a slight amount of hydraulic liquid flows from the pump 2 to the tank 11 through the drain line 24.

The delivery capacity per rotation of the pump 2 is adjusted by a flow rate adjuster 8. The flow rate adjuster 8 will be described below in detail.

A first tank line 6 is branched off from the rod-side supply line 51, and a second tank line 7 is branched off from the head-side supply line 52. The first tank line 6 and the second tank line 7 connect to the tank 11.

The first tank line 6 is provided with a first pilot check valve 61. The first pilot check valve 61 allows a flow from the tank 11 toward the rod-side supply line 51, and prevents the reverse flow. The pressure of the head-side supply line 52 is led to the first pilot check valve 61 through a pilot line 62, and the first pilot check valve 61 stops exerting the function of preventing the reverse flow when the pressure of the head-side supply line 52 is higher than a first setting pressure P1.

The second tank line 7 is provided with a second pilot check valve 71. The second pilot check valve 71 allows a flow from the tank 11 toward the head-side supply line 52, and prevents the reverse flow. The pressure of the rod-side supply line 51 is led to the second pilot check valve 71 through a pilot line 72, and the second pilot check valve 71 stops exerting the function of preventing the reverse flow when the pressure of the rod-side supply line 51 is higher than a second setting pressure P2. It should be noted that the second setting pressure P2 of the second pilot check valve 71 may be equal to or different from the first setting pressure P1 of the first pilot check valve 61.

The aforementioned flow rate adjuster 8 switches the delivery capacity of the pump 2 between a first setting value q1 and a second setting value q2. The second setting value q2 is less than the first setting value q1. For example, the ratio between the first setting value q1 and the second setting value q2 is equal to the ratio between the pressure receiving area of the head-side chamber 42 and the pressure receiving area of the rod-side chamber 41 of the hydraulic cylinder 4.

The pressure of the rod-side supply line 51 and the pressure of the head-side supply line 52 are led to the flow rate adjuster 8 through a pilot line 8*e* and a pilot line 8*f*, respectively. The flow rate adjuster 8 is configured to switch the delivery capacity of the pump 2 to the first setting value q1 when the pressure of the head-side supply line 52 is higher than the pressure of the rod-side supply line 51, and switch the delivery capacity of the pump 2 to the second setting value q2 when the pressure of the rod-side supply line 51 is higher than the pressure of the head-side supply line 52.

To be more specific, the flow rate adjuster 8 includes a servo piston 81. The servo piston 81 is coupled to the swash plate 23 of the pump 2, and is capable of sliding in the axial direction. A first pressure receiving chamber 82, in which a smaller-diameter end portion of the servo piston 81 is exposed, and a second pressure receiving chamber 83, in which a larger-diameter end portion of the servo piston 81 is exposed, are formed in the flow rate adjuster 8.

The first pressure receiving chamber 82 is connected an output port of a high pressure selective valve 84 by an output line 8*c*. Two input ports of the high pressure selective valve 84 are connected to the rod-side supply line 51 and the head-side supply line 52, respectively, by input lines 8*a* and 8*b*. That is, the high pressure selective valve 84 selects and outputs a higher one of the pressure of the rod-side supply line 51 and the pressure of the head-side supply line 52.

The second pressure receiving chamber 83 is connected to a switching valve 85 by a relay line 8*g*. The switching valve 85 is connected to the output port of the high pressure selective valve 84 by an output line 8*d*, and to the tank 11 by a tank line 8*h*. The switching valve 85 includes a pair of pilot ports. These pilot ports are connected to the rod-side supply line 51 and the head-side supply line 52, respectively, by the aforementioned pilot lines 8*e* and 8*f*.

When the pressure of the head-side supply line 52, which is led to the switching valve 85 through the pilot line 8*f*, is higher than the pressure of the rod-side supply line 51, which is led to the switching valve 85 through the pilot line 8*e*, the switching valve 85 is positioned in a first position (left-side position in FIG. 1), in which the switching valve 85 brings the second pressure receiving chamber 83 into communication with the tank 11. Accordingly, the servo piston 81 shifts to the second pressure receiving chamber 83 side to a maximum extent, and thereby the tilting angle of the pump 2 is maximized. Consequently, the delivery capacity of the pump 2 becomes the first setting value q1.

On the other hand, when the pressure of the rod-side supply line 51, which is led to the switching valve 85 through the pilot line 8*e*, is higher than the pressure of the head-side supply line 52, which is led to the switching valve 85 through the pilot line 8*f*, the switching valve 85 is positioned in a second position (right-side position in FIG. 1), in which the switching valve 85 brings the second pressure receiving chamber 83 into communication with the output port of the high pressure selective valve 84. Accordingly, the servo piston 81 shifts to the first pressure receiving chamber 82 side to a maximum extent, and thereby the tilting angle of the pump 2 is minimized. Consequently, the delivery capacity of the pump 2 becomes the second setting value q2.

Although the spring of the switching valve 85 is disposed at the pilot line 8*f* side in the illustrated example, the spring may be disposed at the pilot line 8*e* side.

Next, operations of the hydraulic system 1 are described for the following two cases separately: when the hydraulic cylinder 4 extends; and when the hydraulic cylinder 4 retracts.

(1) When Hydraulic Cylinder 4 Extends

Figure 2B:
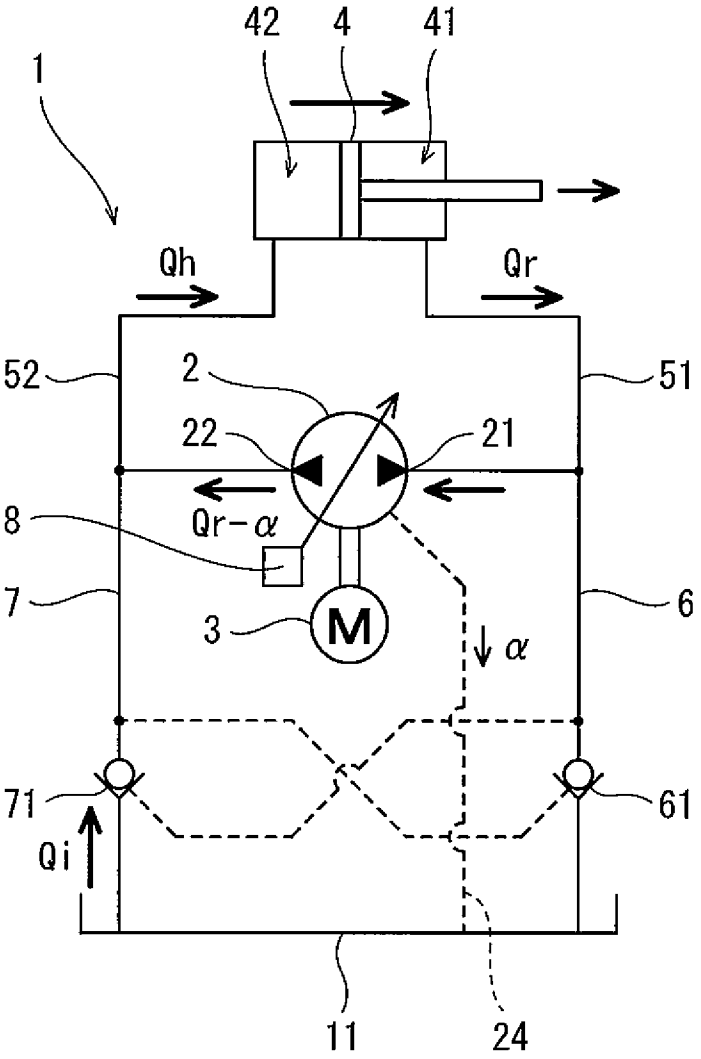
FIGS. 2A and 2B each show a flow of a hydraulic liquid when a hydraulic cylinder extends.
Figure 2A:
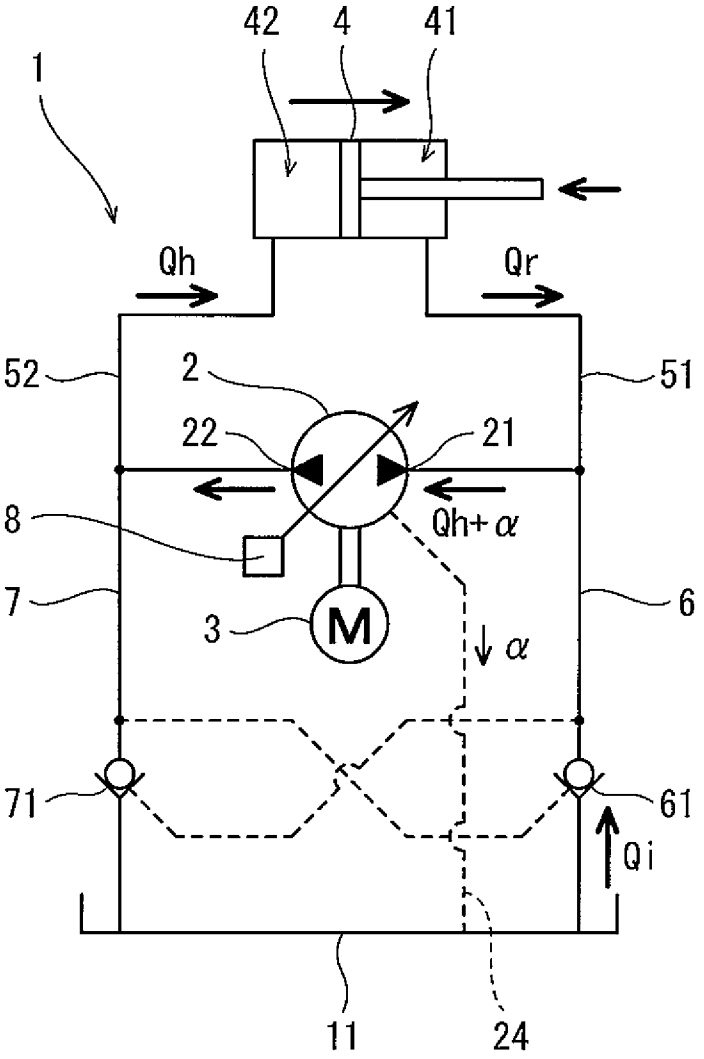

As shown in FIG. 2A, in a case where the load direction when the hydraulic cylinder 4 extends is the retracting direction of the cylinder 4, the pressure of the head-side supply line 52 becomes high against the load, and the speed of the hydraulic cylinder 4 is controlled by the delivery flow rate of the pump 2. Since the pressure of the head-side supply line 52 is higher than the pressure of the rod-side supply line 51, the flow rate adjuster 8 selects the first setting value q1 as the delivery capacity of the pump 2. At the time, the check valve 61 is opened due to the pressure of the head-side supply line 52, and the hydraulic liquid at a flow rate corresponding to the pressure receiving area difference between the head-side chamber 42 and the rod-side chamber 41 of the hydraulic cylinder 4 is sucked from the tank 11 through the first pilot check valve 61 of the first tank line 6.

It should be noted that if the flow rate sucked from the tank 11 is Qi, the flow rate into the head-side chamber 42 is Qh, the flow rate out of the rod-side chamber 41 is Qr, and the drain amount from the pump 2 is α, then $Qi=Qh+\alpha-Qr$.

On the other hand, as shown in FIG. 2B, in a case where the load direction when the hydraulic cylinder 4 extends is the extending direction of the cylinder 4, the pressure of the rod-side chamber 41 becomes high against the load, and the speed of the hydraulic cylinder 4 is controlled by the suction flow rate of the pump 2. Since the pressure of the rod-side supply line 51 is higher than the pressure of the head-side supply line 52, the flow rate adjuster 8 switches the delivery capacity of the pump 2 to the second setting value q2. At the time, the check valve 71 is opened due to the pressure of the rod-side supply line 51, and the hydraulic liquid at a flow rate corresponding to the pressure receiving area difference between the head-side chamber 42 and the rod-side chamber 41 of the hydraulic cylinder 4 is sucked from the tank 11 through the second pilot check valve 71 of the second tank line 7. Also at the time, the following equation holds true: $Qi=Qh+\alpha-Qr$.

Owing to the above configuration, if the load direction is reversed from the retracting direction into the extending direction when the hydraulic cylinder 4 extends, the direction of the force applied against the load changes, and the pressure of the rod-side supply line 51 becomes high. Accordingly, the smaller one of the delivery capacities of the pump 2 is selected, and the delivery flow rate of the pump 2 decreases. That is, at the time, the cylinder speed control is switched from the control by the supply flow rate to the head side to the control by the discharge flow rate from the rod side, and concurrently, the pump delivery flow rate decreases. This consequently makes it possible to suppress a change (an increase) in the speed of the hydraulic cylinder 4 without instantaneously changing the rotation speed of the rotating machine 3. In addition, at the time, the passage of the hydraulic liquid sucked from the tank 11 is switched from the first tank line 6 to the second tank line 7, and thereby the hydraulic liquid at a flow rate corresponding to the pressure receiving area difference between the head-side chamber 42 and the rod-side chamber 41 of the hydraulic cylinder 4 is fed in a manner to cover a shortfall in the delivery flow rate of the pump 2.

On the other hand, if the load direction is reversed from the extending direction into the retracting direction when the hydraulic cylinder 4 extends, the pressure of the head-side supply line 52 becomes high. Accordingly, the greater one of the delivery capacities of the pump 2 is selected, and the delivery flow rate of the pump 2 increases. That is, at the time, the cylinder speed control is switched from the control by the discharge flow rate from the rod side to the control by the supply flow rate to the head side, and concurrently, the pump delivery flow rate increases. This consequently makes it possible to suppress a change (a decrease) in the speed of the hydraulic cylinder 4 without instantaneously changing the rotation speed of the rotating machine 3. In addition, at the time, the passage of the hydraulic liquid sucked from the tank 11 is switched from the second tank line 7 to the first tank line 6, and thereby the hydraulic liquid at a flow rate corresponding to the pressure receiving area difference between the head-side chamber 42 and the rod-side chamber 41 of the hydraulic cylinder 4 is fed in a manner to cover a shortfall in the suction flow rate of the pump 2.

(2) When Hydraulic Cylinder 4 Retracts

Figure 3B:
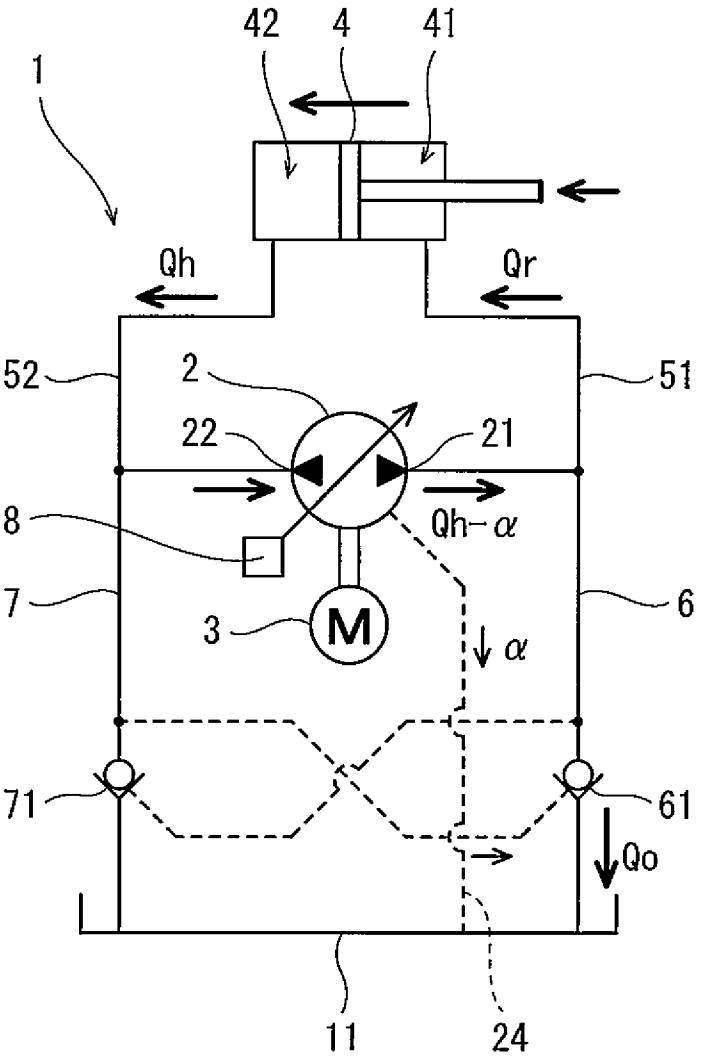
FIGS. 3A and 3B each show a flow of the hydraulic liquid when the hydraulic cylinder retracts.
Figure 3A:
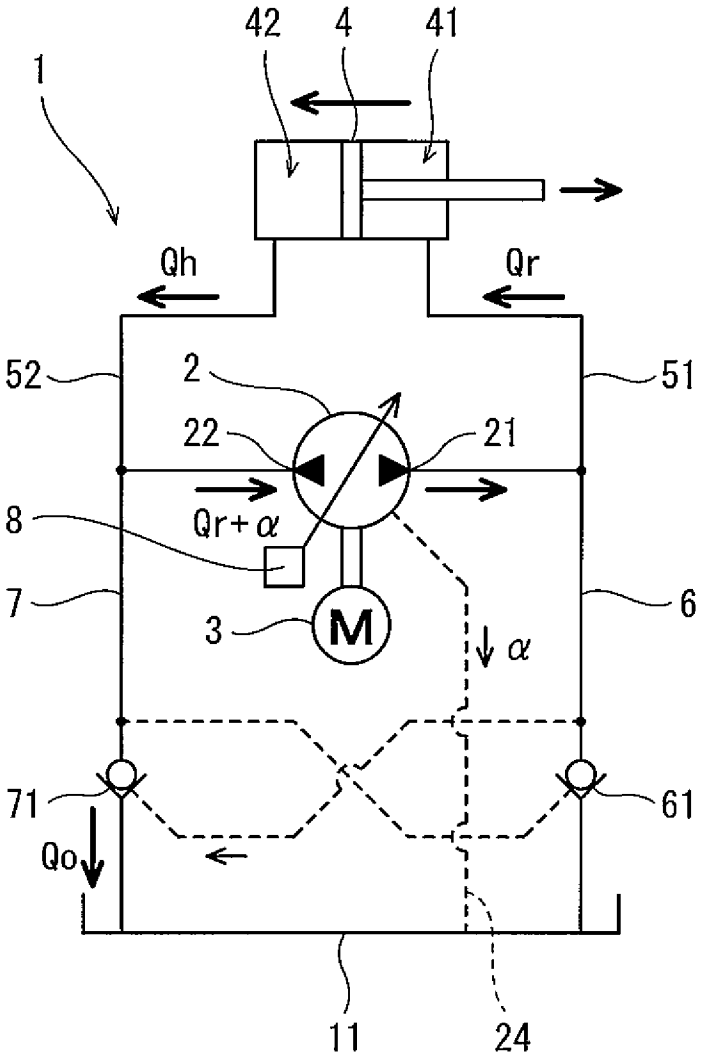

As shown in FIG. 3A, in a case where the load direction when the hydraulic cylinder 4 retracts is the extending direction, the pressure of the rod-side supply line 51 becomes high against the load, and the speed of the hydraulic cylinder 4 is controlled by the delivery flow rate of the pump 2. Since the pressure of the rod-side supply line 51 is higher than the pressure of the head-side supply line 52, the flow rate adjuster 8 selects the second setting value q2 as the delivery capacity of the pump 2. At the time, the second pilot check valve 71 of the second tank line 7 is opened due to the pressure of the rod-side supply line 51, and the hydraulic liquid at a flow rate corresponding to the pressure receiving area difference between the head-side chamber 42 and the rod-side chamber 41 of the hydraulic cylinder 4 flows into the tank 11 through the second tank line 7.

It should be noted that if the flow rate into the tank 11 is Qo, then $Qo=Qh-Qr-\alpha$.

On the other hand, as shown in FIG. 3B, in a case where the load direction when the hydraulic cylinder 4 retracts is the retracting direction, the pressure of the head-side chamber 42 becomes high against the load, and the speed of the hydraulic cylinder 4 is controlled by the suction flow rate of the pump 2. Since the pressure of the head-side supply line 52 is higher than the pressure of the rod-side supply line 51, the flow rate adjuster 8 selects the first setting value q1 as the delivery capacity of the pump 2. At the time, the first pilot check valve 61 of the first tank line 6 is opened due to the pressure of the head-side supply line 52, and the hydraulic liquid at a flow rate corresponding to the pressure receiving area difference between the head-side chamber 42 and the rod-side chamber 41 of the hydraulic cylinder 4 flows into the tank 11 through the first tank line 6. Also at the time, the following equation holds true: $Qo=Qh-Qr-\alpha$.

Owing to the above configuration, if the load direction is reversed from the extending direction into the retracting direction when the hydraulic cylinder retracts, the direction of the force applied against the load changes, and the pressure of the head-side supply line 52 becomes high. Accordingly, the greater one of the delivery capacities of the pump 2 is selected, and the delivery flow rate of the pump 2 increases. That is, at the time, the cylinder speed control is switched from the control by the supply flow rate to the rod side to the control by the discharge flow rate from the head side, and concurrently, the pump delivery flow rate increases. This consequently makes it possible to suppress a change (a decrease) in the speed of the hydraulic cylinder 4 without instantaneously changing the rotation speed of the rotating machine 3. In addition, at the time, the passage of the hydraulic liquid flowing into the tank 11 is switched from the second tank line 7 to the first tank line 6, and thereby the hydraulic liquid at a flow rate corresponding to the pressure receiving area difference between the head-side chamber 42 and the rod-side chamber 41 of the hydraulic cylinder 4 flows into the tank 11 through the first tank line 6.

On the other hand, if the load direction is reversed from the retracting direction into the extending direction when the hydraulic cylinder 4 retracts, the pressure of the rod-side supply line 51 becomes high. Accordingly, the smaller one of the delivery capacities of the pump 2 is selected, and the delivery flow rate of the pump 2 decreases. That is, at the time, the cylinder speed control is switched from the control by the discharge flow rate from the head side to the control by the supply flow rate to the rod side, and concurrently, the pump delivery flow rate decreases. This consequently makes it possible to suppress a change (an increase) in the speed of the hydraulic cylinder 4 without instantaneously changing the rotation speed of the rotating machine 3. In addition, at the time, the passage of the hydraulic liquid flowing into the tank 11 is switched from the first tank line 6 to the second tank line 7, and thereby the hydraulic liquid at a flow rate corresponding to the pressure receiving area difference between the head-side chamber 42 and the rod-side chamber 41 flows into the tank 11 through the second tank line 7.

As described above, the hydraulic system 1 of the present embodiment is capable of suppressing a change in the speed of the hydraulic cylinder 4 in both cases where the load direction is reversed when the hydraulic cylinder 4 extends and where the load direction is reversed when the hydraulic cylinder 4 retracts, without instantaneously changing the rotation speed of the rotating machine 3. Moreover, the pressure of the rod-side supply line 51 and the pressure of the head-side supply line 52 are led to the flow rate adjuster 8, and the operation of the flow rate adjuster 8 is controlled by these pressures. Therefore, it is not necessary to electrically control the flow rate adjuster 8.

Further, in the present embodiment, the ratio between the first setting value q1 and the second setting value q2 is equal to the ratio between the pressure receiving area of the head-side chamber 42 and the pressure receiving area of the rod-side chamber 41 of the hydraulic cylinder 4. This makes it possible to markedly suppress a change in the speed of the hydraulic cylinder 4.

(Variations)

The present invention is not limited to the above-described embodiment. Various modifications can be made without departing from the scope of the present invention.

Figure 4:
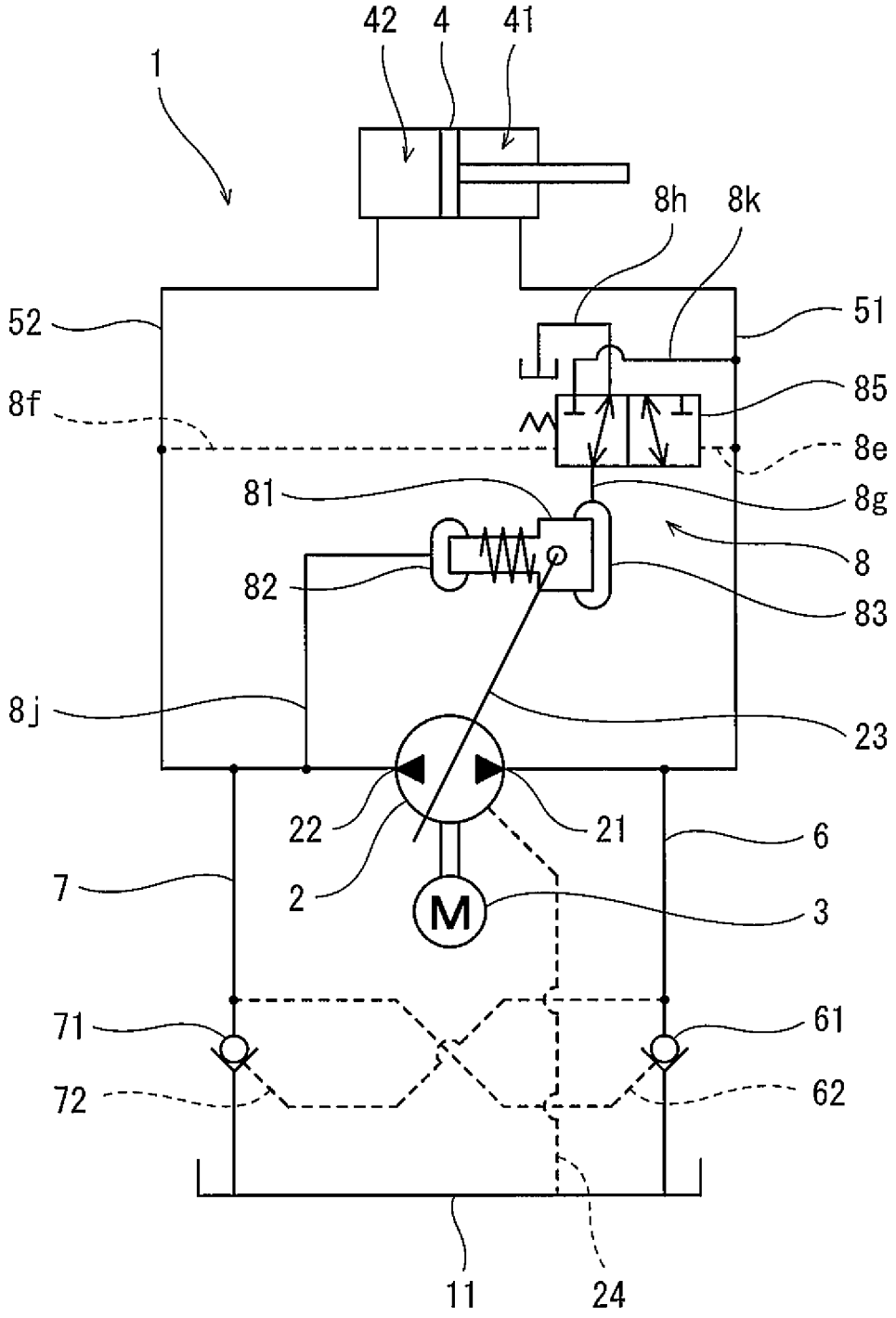
FIG. 4 shows a schematic configuration of a hydraulic system according to a variation.
Figure 5B:
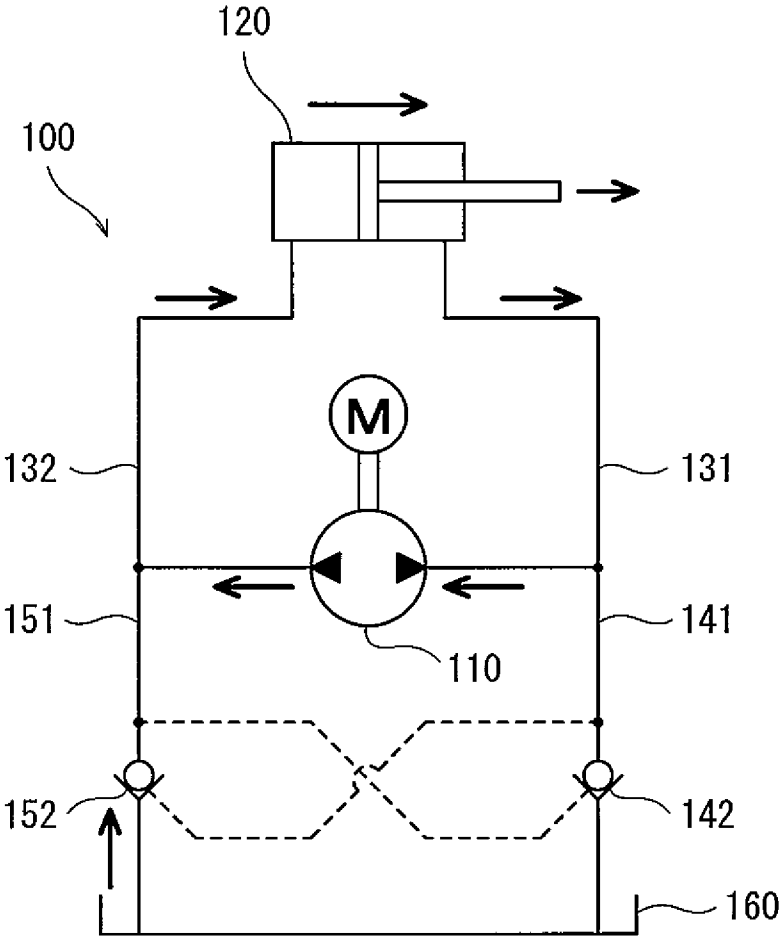
FIGS. 5A and 5B each show a schematic configuration of a conventional hydraulic system, and each show a flow of a hydraulic liquid when a hydraulic cylinder extends.
Figure 5A:
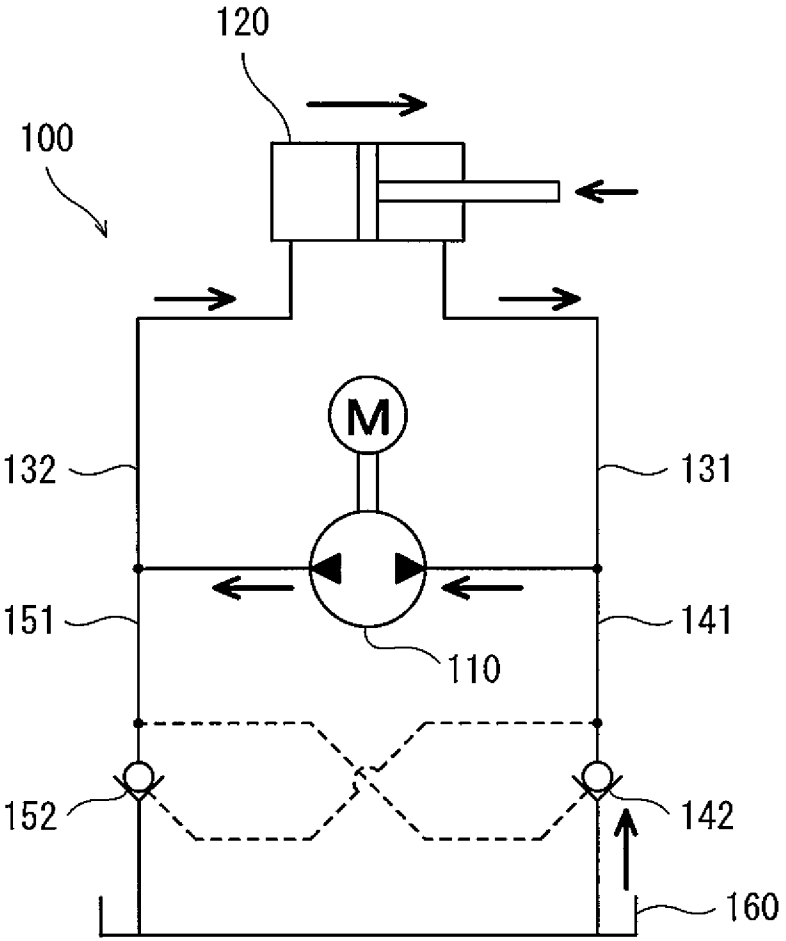
Figure 6B:
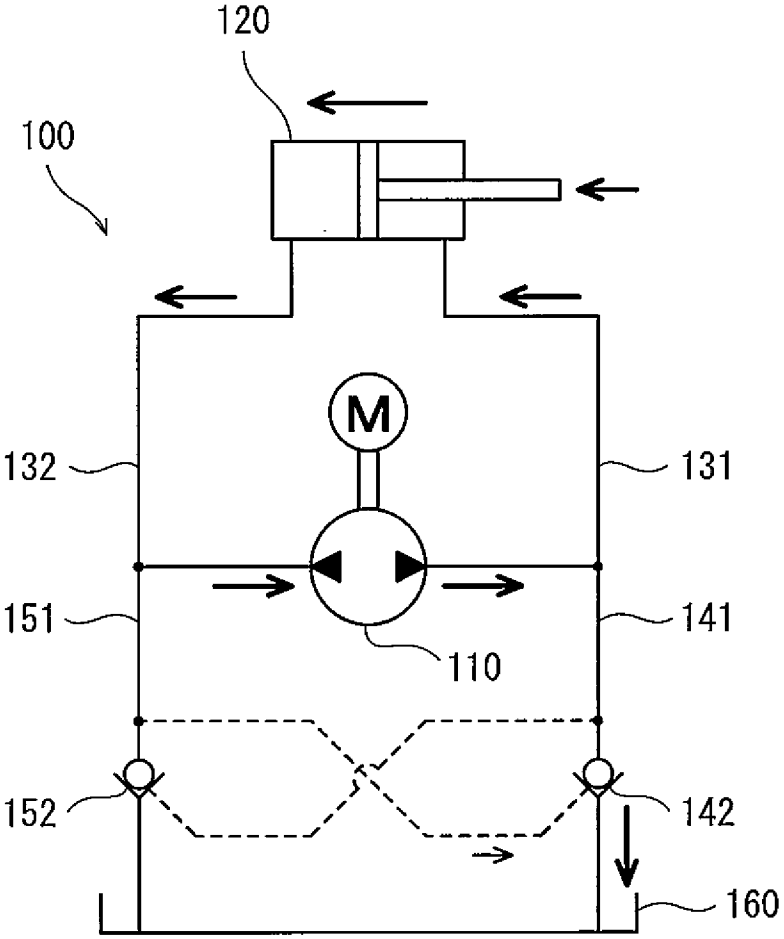
FIGS. 6A and 6B each show a schematic configuration of the conventional hydraulic system, and each show a flow of the hydraulic liquid when the hydraulic cylinder retracts.
Figure 6A:
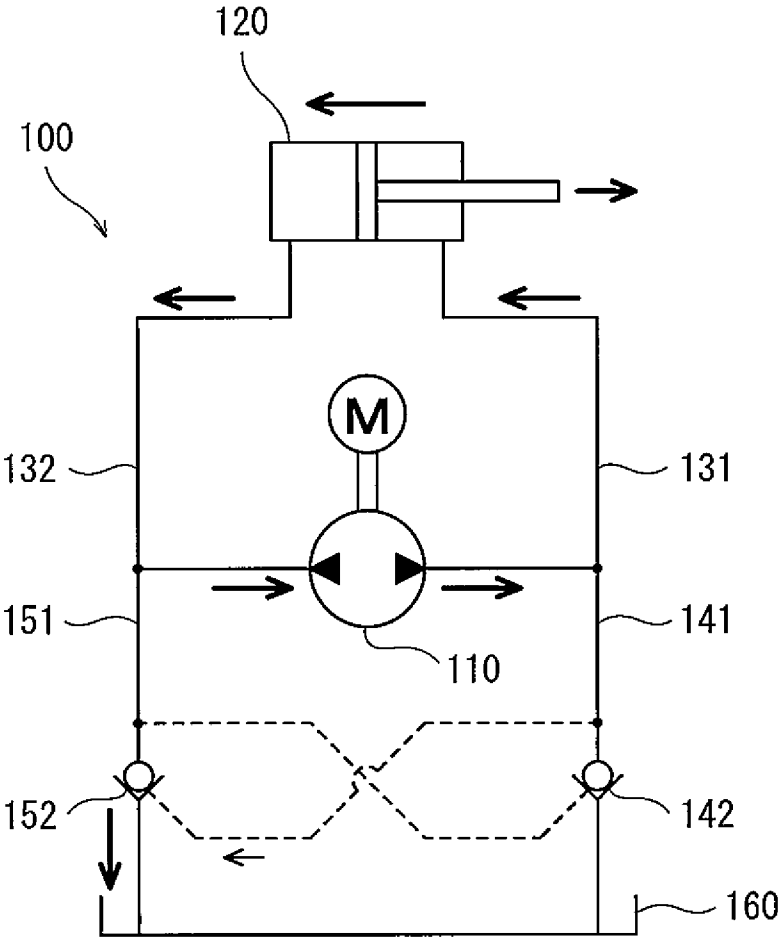

For example, the flow rate adjuster 8 is not limited to one having the configuration shown in FIG. 1, but may have an alternative configuration as shown in FIG. 4. Specifically, in the configuration shown in FIG. 4, the high pressure selective valve 84 (see FIG. 1) is not adopted; the first pressure receiving chamber 82 is connected to the head-side supply line 52 by a first pressure leading line 8*j*; and the switching valve 85 is connected to the rod-side supply line 51 by a second pressure leading line 8*k*. That is, the switching valve 85 switches whether to bring the second pressure receiving chamber 83 into communication with the tank 11 or to bring the second pressure receiving chamber 83 into communication with the rod-side supply line 51.

REFERENCE SIGNS LIST

1 hydraulic cylinder
11 tank
2 pump
21 first port
22 second port
3 rotating machine
4 hydraulic cylinder
41 rod-side chamber
42 head-side chamber
51 rod-side supply line
52 head-side supply line
6 first tank line
61 first pilot check valve
7 second tank line
71 second pilot check valve
8 flow rate adjuster

The invention claimed is:

1. A hydraulic system comprising:

a single-rod hydraulic cylinder including a rod-side chamber and a head-side chamber;

a variable displacement pump driven by a rotating machine, the pump including a first port and a second port;

a flow rate adjuster that switches a delivery capacity per rotation of the pump between a first setting value and a second setting value less than the first setting value;

a rod-side supply line that connects the first port to the rod-side chamber;

a head-side supply line that connects the second port to the head-side chamber in a manner to form a closed circuit together with the pump, the rod-side supply line, and the hydraulic cylinder;

a first tank line that is branched off from the rod-side supply line and connects to a tank;

a first pilot check valve provided on the first tank line, the first pilot check valve allowing a flow from the tank toward the rod-side supply line and preventing a reverse flow, but stopping exerting a function of preventing the reverse flow when a pressure of the head-side supply line is higher than a first setting pressure;

a second tank line that is branched off from the head-side supply line and connects to the tank; and a second pilot check valve provided on the second tank line, the second pilot check valve allowing a flow from the tank toward the head-side supply line and preventing a reverse flow, but stopping exerting a function of preventing the reverse flow when a pressure of the rod-side supply line is higher than a second setting pressure, wherein the pressure of the rod-side supply line and the pressure of the head-side supply line are led to the flow rate adjuster, and the flow rate adjuster is configured to:

switch the delivery capacity of the pump to the first setting value when the pressure of the head-side supply line is higher than the pressure of the rod-side supply line; and switch the delivery capacity of the pump to the second setting value when the pressure of the rod-side supply line is higher than the pressure of the head-side supply line.

2. The hydraulic system according to claim 1, wherein a ratio between the first setting value and the second setting value is equal to a ratio between a pressure receiving area of the head-side chamber and a pressure receiving area of the rod-side chamber of the hydraulic cylinder.

3. The hydraulic system according to claim 1, wherein the rotating machine is a servomotor, and a delivery side and a suction side of the first and second ports of the pump are switched with each other in accordance with a rotation direction of the rotating machine.

4. The hydraulic system according to claim 1, wherein a delivery side and a suction side of the first and second ports of the pump are switched with each other by tilting a swash plate or a tilted axis of the pump bi-directionally over a reference line.

5. A hydraulic system comprising:

a single-rod hydraulic cylinder including a rod-side chamber and a head-side chamber;

a variable displacement pump driven by a rotating machine, the pump including a first port and a second port;

a flow rate adjuster that switches a delivery capacity per rotation of the pump between a first setting value and a second setting value less than the first setting value;

a rod-side supply line that connects the first port to the rod-side chamber;

a head-side supply line that connects the second port to the head-side chamber in a manner to form a closed circuit together with the pump, the rod-side supply line, and the hydraulic cylinder;

a first tank line that is branched off from the rod-side supply line and connects to a tank;

a check valve provided on the first tank line, the check valve allowing a flow from the tank toward the rod-side supply line and preventing a reverse flow;

a second tank line that is branched off from the head-side supply line and connects to the tank; and a pilot check valve provided on the second tank line, the pilot check valve allowing a flow from the tank toward the head-side supply line and preventing a reverse flow, but stopping exerting a function of preventing the reverse flow when a pressure of the rod-side supply line is higher than a setting pressure, wherein the pressure of the rod-side supply line and the pressure of the head-side supply line are led to the flow rate adjuster, and the flow rate adjuster is configured to:

switch the delivery capacity of the pump to the first setting value when the pressure of the head-side supply line is higher than the pressure of the rod-side supply line; and switch the delivery capacity of the pump to the second setting value when the pressure of the rod-side supply line is higher than the pressure of the head-side supply line.

* * * * *